US006230445B1

(12) United States Patent
Arko et al.

(10) Patent No.: US 6,230,445 B1
(45) Date of Patent: May 15, 2001

(54) ADJUSTABLE RACK FOR PARTITION SYSTEM

(75) Inventors: Robert P. Arko, Palo Alto, CA (US); Scott Klinker, Kanazawa (JP); Heather Andrus, San Francisco; James Yurchenko, Palo Alto, both of CA (US)

(73) Assignee: Steelcase Development Inc., Caledonia, MI (US)

( * ) Notice: Subject to any disclaimer, the term of this patent is extended or adjusted under 35 U.S.C. 154(b) by 0 days.

(21) Appl. No.: 09/299,543

(22) Filed: Apr. 26, 1999

(51) Int. Cl.[7] ..... E04B 2/74

(52) U.S. Cl. ..... 52/36.5; 52/36.1; 52/36.4; 52/36.6; 211/90

(58) Field of Search ..... 52/36.1, 36.4, 52/36.5, 36.6

(56) References Cited

U.S. PATENT DOCUMENTS

| | | | | |
|---|---|---|---|---|
| 3,425,568 | | 2/1969 | Albright . | |
| 3,514,883 | | 6/1970 | Albright . | |
| 3,563,182 | * | 2/1971 | MacFarlan et al. | 108/29 |
| 4,619,486 | | 10/1986 | Hannah et al. . | |
| 4,883,330 | | 11/1989 | Armstrong et al. . | |
| 5,220,871 | | 6/1993 | Grund et al. . | |
| 5,746,034 | | 5/1998 | Luchetti et al. . | |
| 5,746,035 | | 5/1998 | Seiber et al. . | |
| 5,852,904 | * | 12/1998 | Yu et al. | 52/220.7 |
| 5,890,325 | | 4/1999 | Corcorran et al. . | |
| 6,024,230 | * | 12/1998 | Menaged et al. | 211/87.01 |

OTHER PUBLICATIONS

Exhibit A is a brochure entitled *Knoll—Hannah Desk System,* 18 pages, dated Oct. 1986.

Exhibit B is a brochure entitled *Knoll—Hannah Desk System,* 13 pages, undated but published in 1986.

Exhibit C is a publication entitled *Knoll—Hannah Desk System—Electrical Assembly Guide,* (12 pages, undated but published in 1986.

Exhibit D is a publication entitled *Knoll—Hannah Desk System—Assembly Guide,* 12 pages, undated but published in 1986.

* cited by examiner

*Primary Examiner*—Carl D. Friedman
*Assistant Examiner*—Pat J. Chavez
(74) *Attorney, Agent, or Firm*—Price, Heneveld, Cooper, DeWitt & Litton

(57) ABSTRACT

A wall system includes a wall section, such as a section of a partition, having a horizontal frame defining a horizontal row of attachment sites, such as a row of slots. An adjustable bracket includes a pair of vertical blades constructed to engage selected ones of the attachment sites, and further includes at least one telescoping horizontal support spanning between and supported by the pair of vertical blades, and still further includes universal connector brackets for engaging the telescoping horizontal support. The horizontal spacing of the blades can be adjusted to accommodate a component, and the telescopingly adjustable horizontal support can be adjusted to reach between the blades. The universal connectors adjustably engage the horizontal support and include slots to facilitate attachment to connectors on a back, a bottom, or sides of the component. By this arrangement and method, a single adjustable bracket can be adjusted to accommodate a wide variety of different components, despite specific dimensions on the component that are not known ahead of time.

23 Claims, 4 Drawing Sheets

ADJUSTABLE RACK FOR PARTITION SYSTEM

BACKGROUND OF THE INVENTION

The present invention relates to adjustable racks, and more particularly relates to an adjustable rack that is adapted for adjustable attachment to a partition system, and further is itself adjustable to facilitate attachment of wall-supported components to the rack.

Recently, a novel partition system was developed by Steelcase that permits attachment of items to the partition system in any one of a plurality of horizontally spaced discrete attachment locations. However, further adjustability is desired. Specifically, there is a need for a universally adjustable bracket adapted to receive and support components on the partition system, where the connection sites on the particular component of choice are not precisely known ahead of the time of installation. Known adjustable brackets are not able to satisfactorily accommodate a wide variety of shapes, sizes, and weights of components without requiring a myriad of parts and pieces. Further, the adjustable bracket should flexibly provide for vertical adjustability and also provide for management of wires and cabling from the component into the partition system.

Accordingly, an adjustable rack is desired that is reliable, is relatively non-complex, solves the aforementioned problems, and has the aforementioned advantages.

SUMMARY OF THE INVENTION

In one aspect of the present invention, a wall system includes a wall section having a horizontal frame defining a horizontal row of attachment sites, and an adjustable bracket including a pair of vertical blades constructed to engage selected ones of the attachment sites. The adjustable bracket further includes at least one telescoping horizontal support spanning between and supported by the pair of vertical blades, and still further includes universal connectors for engaging the telescoping horizontal support.

In another aspect of the present invention, a method includes steps of providing a wall having a frame with a horizontal row of attachment sites thereon, and providing an adjustable bracket configured to selectively engage the attachment sites. The adjustable bracket includes a pair of vertical blades, at least one horizontally extendable support, and universal connectors. A component is provided having attachment locations thereon. The method includes attaching the pair of vertical blades to the wall at a spacing sufficient to receive the component therebetween, and attaching the at least one horizontally extendable support to the pair of vertical blades including adjusting a length of the at least one horizontally extendable support. The method still further includes using the universal connectors to attach the component to the at least one horizontally extendable support, including adjusting the universal connectors to engage the attachment locations.

These and other features, objects, and advantages of the present invention will become apparent to a person of ordinary skill upon reading the following description and claims together with reference to the accompanying drawings.

DETAILED DESCRIPTION OF PREFERRED EMBODIMENT

Figure 3:
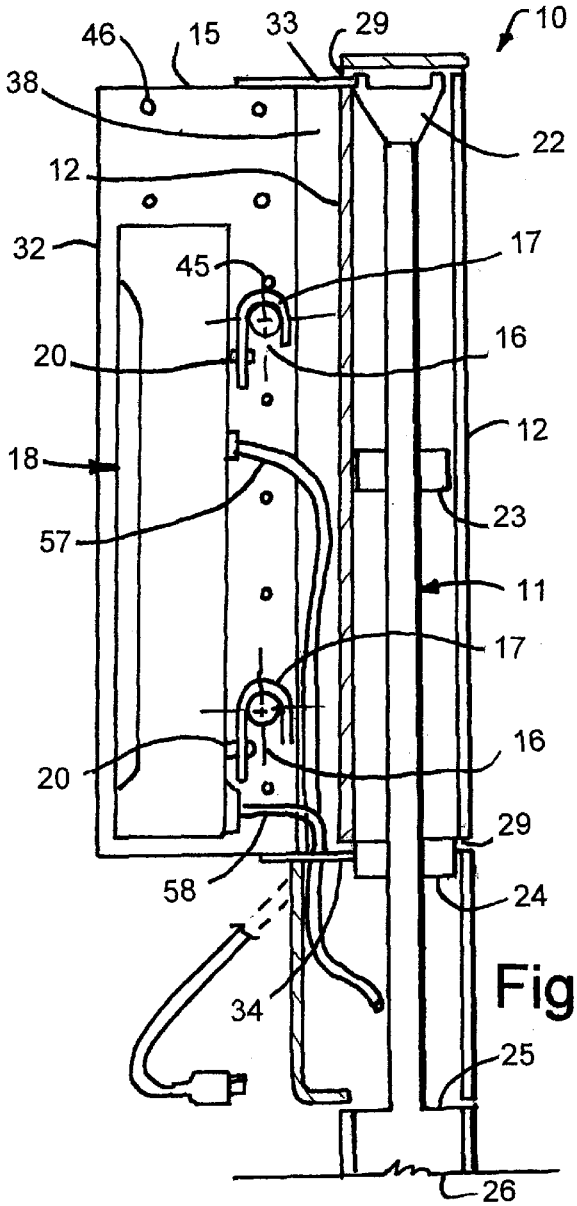
FIG. 3 is an end view of the partition system and rack shown in FIG. 2.
Figure 5:
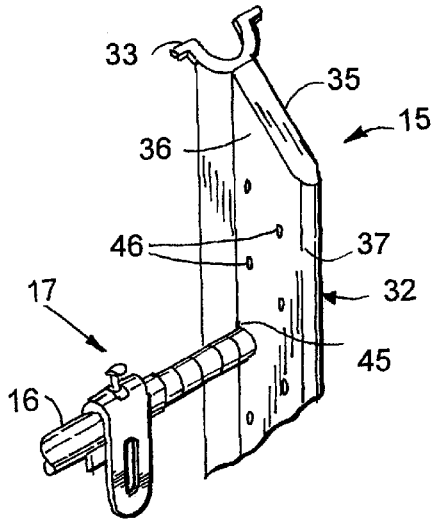
Fig. 5 is a perspective view showing a vertical blade, a telescoping horizontal support and a universal connector.
Figure 4:
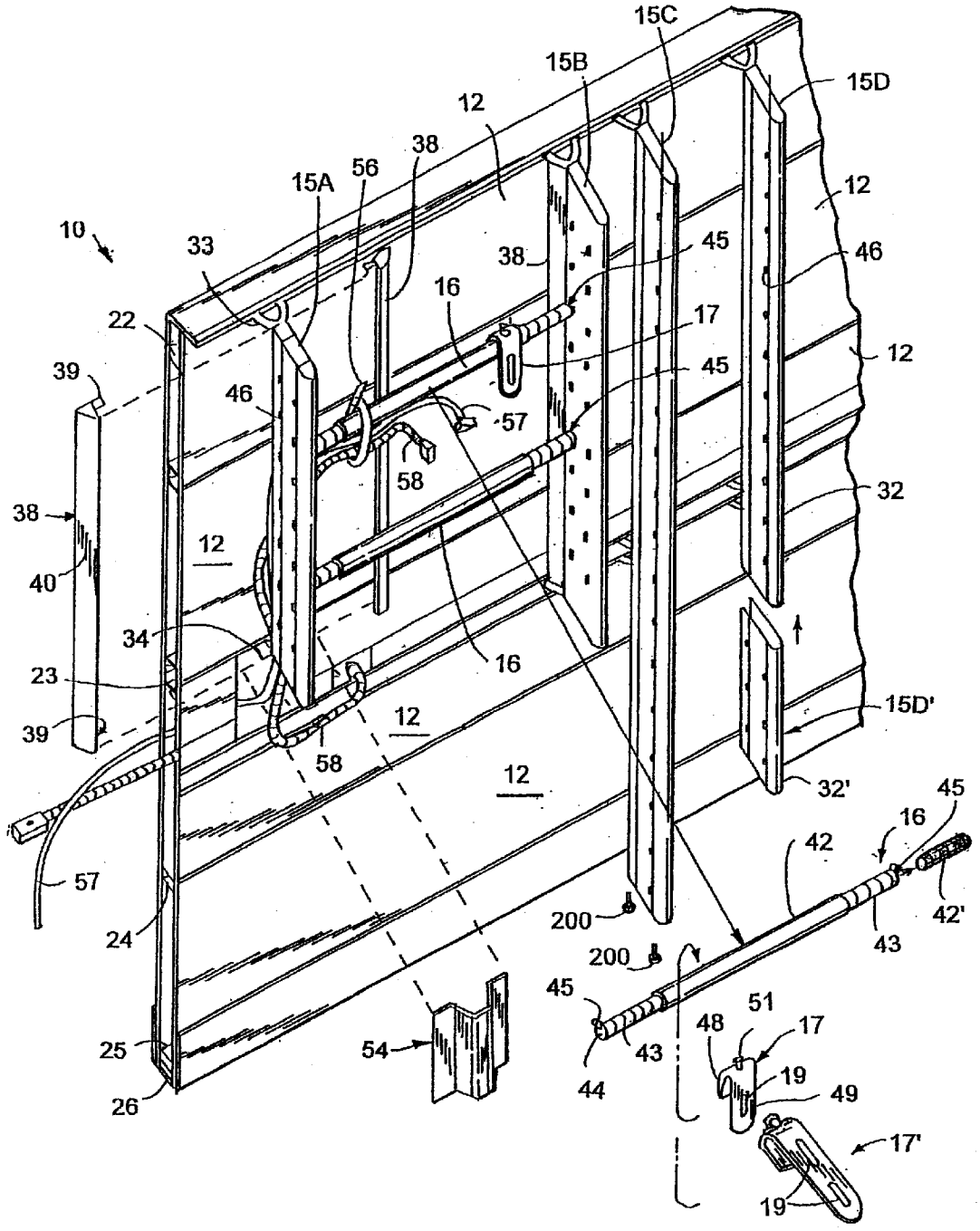
FIG. 4 is an exploded perspective view showing components of the adjustable rack and showing wire routing.

A wall system (FIG. 1) embodying the present invention includes a wall section, such as the illustrated freestanding partition 10 having a rigid partition frame 11 covered by covers 12. The partition frame 11 includes one or more horizontal rows of discrete attachment sites, such as the illustrated rows of slots 13 accessible above, below, or between the covers 12. An adjustable bracket 14 includes a pair of vertical blades 15 constructed to engage selected ones of the slots 13, and further includes at least one telescoping horizontal support 16 (FIG. 2) spanning between and supported by the pair of vertical blades 15. Universal connectors 17 (FIG. 3) engage the telescoping horizontal support 16. The horizontal spacing of the blades 15 can be adjusted to accommodate a component 18, such as a plasma screen or video display terminal, and the telescopingly adjustable horizontal support 16 can be adjusted to reach between the blades 15. The universal connectors 17 cooperate with the adjustable bracket 14 by adjustably engaging the horizontal support 16. The universal connectors 17 include slots 19 (FIG. 4) to facilitate attachment to connector locations 20 (FIG. 3) on a back, a bottom, or sides of the component 18. By this arrangement and method, a single adjustable bracket 14 can be adjusted to accommodate a wide variety of different components, despite specific dimensions on the component 18 that are not known ahead of time.

The present wall system is described herein in sufficient detail below for an understanding of the present invention. Nonetheless, a more detailed description of several embodiments of the present wall system are described in U.S. Pat. No. 5,746,035, issued May 5, 1998, entitled Partition System, and in U.S. Pat. No. 5,943,834, issued Aug. 31, 1999, entitled Partition Construction, the entire contents of both of which are incorporated herein by reference in their entirety.

Figure 1:
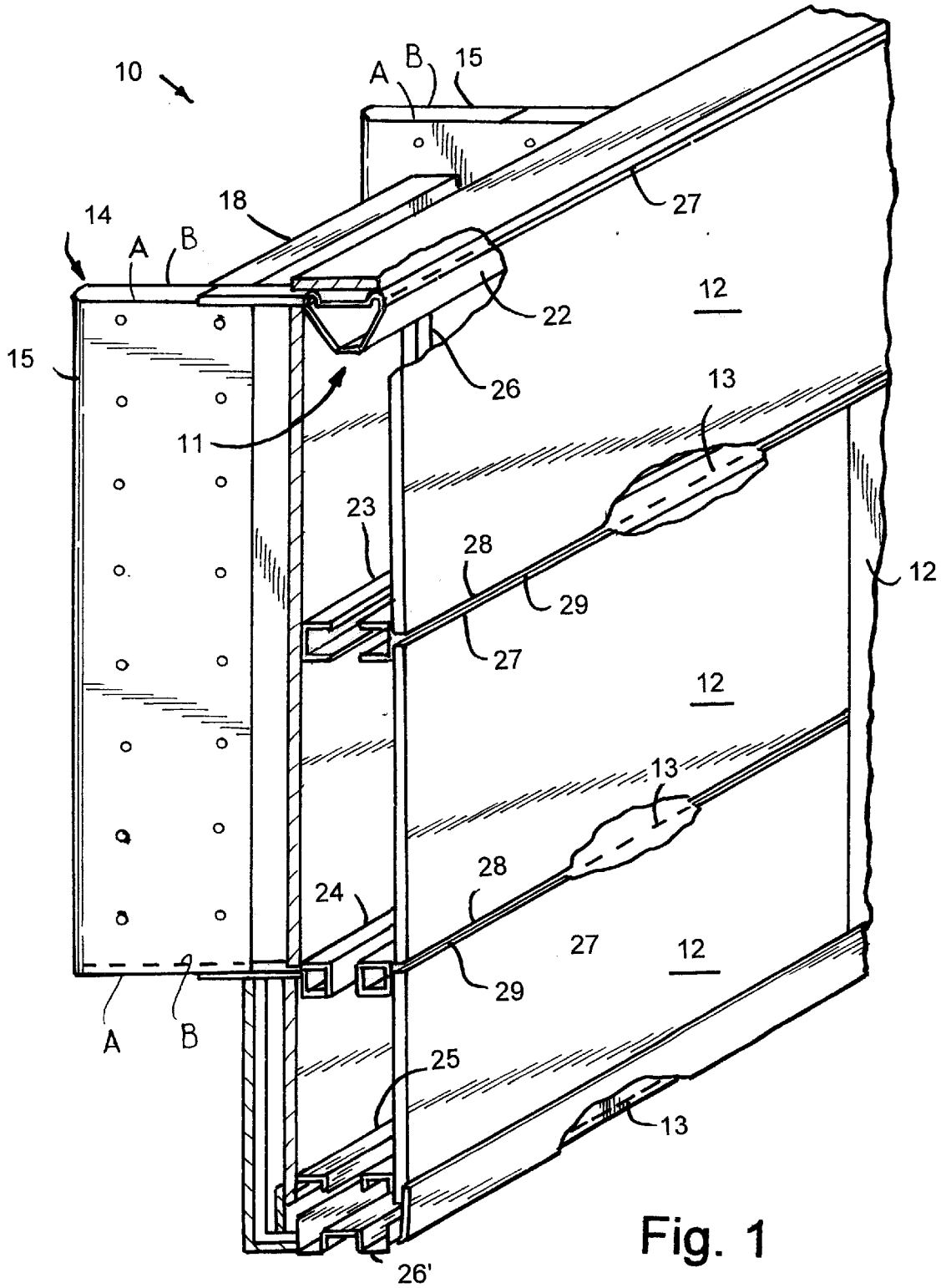
FIG. 1 includes a perspective view of a partition system including an adjustable rack embodying the present invention.

The partition frame 11 (FIG. 1) includes the horizontal frame members 22–25 rigidly interconnected by at least two uprights 26. The uprights 26 are spaced inboard of ends of the horizontal frame members 22–25. The illustrated horizontal frame members 22–25 each have a different shape, but it is to be recognized that two or more can have similar shapes. The illustrated top frame member 22 is tubular, while one intermediate frame member 23 is a single roll-formed beam having inwardly facing C-shaped side wings. The second intermediate frame member 24 is actually two parallel square tubes, and the lower frame member 25 is an M-shaped roll-formed member. Each of the horizontal frame members 22–25 includes a vertical planar face that is structural and that includes one or more horizontal rows of slots 13. The partition frame 11 is supported on and secured to a W-shaped floor channel 26', which also includes a vertical planar face that is structural and that includes a horizontal row of slots 13. The covers 12 include spring clips or other frame-engaging attachment devices (not specifically shown), and include top and bottom edges 27 and 28. Adjacent covers 12 form slits 29, through which the slots 13 are accessible. Further, the slots 13 are accessible over a highest one of the top edges 27 and also are accessible under a lowest one of the bottom edges 28. Notably, covers 12 having different vertical heights and different horizontal lengths can be used, as illustrated in FIG. 1.

The blades 15 are disclosed below in sufficient detail for an understanding of the present invention. Nonetheless, a more detailed description of the blades 15 can be found in U.S. Pat. No. 6,076,308, issued Jun. 20, 2000, entitled Partition Panel System With Adjustable Overhead Storage--therefor. the entire contents of which is incorporated herein by reference.

The blades 15 include a short blade 15A (FIG. 4), an intermediate length blade 15B, a down-to-floor long blade 15C, having floor-engaging feet 200 and a blade 15D having a telescoping lower section 15D' described below. The blades 15A–15D are of similar construction, with each including a vertical C-shaped structural body 32 and top and bottom hook connectors 33 and 34 attached to the structural body 32. The structural body 32 is made of sheet metal and includes an inner panel 35, an outer panel 36 and a rounded nose 37 that combine together to define a distinctive and functionally strong continuous cross section. A length of the structural bodies 32 for each of the blades 15A–15D can be varied to provide any desired vertical span. The blade 15D is telescopingly adjustable and includes a lower body section 32' that is shaped to telescope onto a bottom of the structural body 32 of blade 15D. The lower body section 32' can be secured to the upper body section 32 of blade 15D by means known in the art, such as by screws or fasteners. For example the fasteners could be extended through the apertures in the side panels 35 and 36 of the upper body 32 and through corresponding apertures in the lower body section 32'.

The inner and outer panels 35 and 36 are reinforced and anchored to each other by an internal stiffener (not specifically shown) that rigidifies panels 35 and 36 sufficiently to hold the loads for which they are designed. The top and bottom hook connectors 33 and 34 are secured to tops and bottoms of the inner and outer panels 35 and 36, respectively, at the rear edges of the panels 35 and 36. The top and bottom hook connectors 33 and 34 are vertically thin enough to reach through the slits 29 or to reach over or under a cover 12. The hooks 37 on the inboard ends of the hook connectors 33 and 34 are configured to frictionally engage the slots 13. Preferably, the hooks 37 of the hook connectors 33 and 34 face horizontally and laterally, so that the hooks 37 can be easily slid through the slits 29 without damage to the covers 12, and also so that the hooks 37 can be slid along the partition frame 11 to engage the hooks 37 into the slots 13. The hook connectors 33 and 34 are long enough to space the body 32 away from the outer face of the covers 12. This leaves a wire passageway between the body 32 and the covers 12. Wire covers 38 include clips 39 that are configured to frictionally engage and attach to the top and bottom connectors 33 and 34 (or to the slots 13), and the wire covers 38 include a body 40 shaped to cover visible sides of this wire passageway.

The telescoping horizontal supports 16 include a center tube 42 and one or two opposing end rods 43 that engage ends of the center tube 42. The illustrated rods 43 threadably engage the center tube 42, thus providing a sure connection that cannot unexpectedly telescope apart. This may be required if the component 18 to be supported justifies this increased security, but the threads are not believed to be necessary in all circumstances. Sleeves 42' can be used to cover the threads if improved aesthetics are desired. The outer ends 44 of the rods 43 (and the outer end of the center tube 42 if there is only one rod 43) includes a downwardly hooked finger 45 shaped to mateably securely engage the apertures 46 in the inner panels 36. The finger 45 is shaped so that it is not easily jarred loose simply by bumping or lifting the horizontal support 16 upwardly. This can be accomplished by extending a length of the finger 45 significantly downwardly or by making the finger 45 rotate as it engages the blade 15. Several different ways are known to accomplish this feature. A pair of the horizontal supports 16 can be attached to the blades 15, either vertically spaced from each other (as illustrated) or horizontally spaced one in front of the other.

The universal connector 17 (FIG. 4) is J-shaped and includes a U-shaped first end 48 shaped to frictionally engage the horizontal support 16, and further includes an extended second end 49 having the slot 19 therein. The illustrated U-shaped first end 48 includes a set screw 51 for added stability and sureness of its connection to the horizontal support 16. The universal connector 17' is similar to the connector 17, but is configured to extend forwardly to provide for a bottom attachment to the component 18. The universal connector 17' includes a pair of slots 19. It is contemplated that a variety of additional connectors can be provided to adapt the present system to a particular component 18, but it is desired that, where possible, the connector 17 will be constructed for universal use, such that only a limited number of such connectors will be needed.

Figure 2:
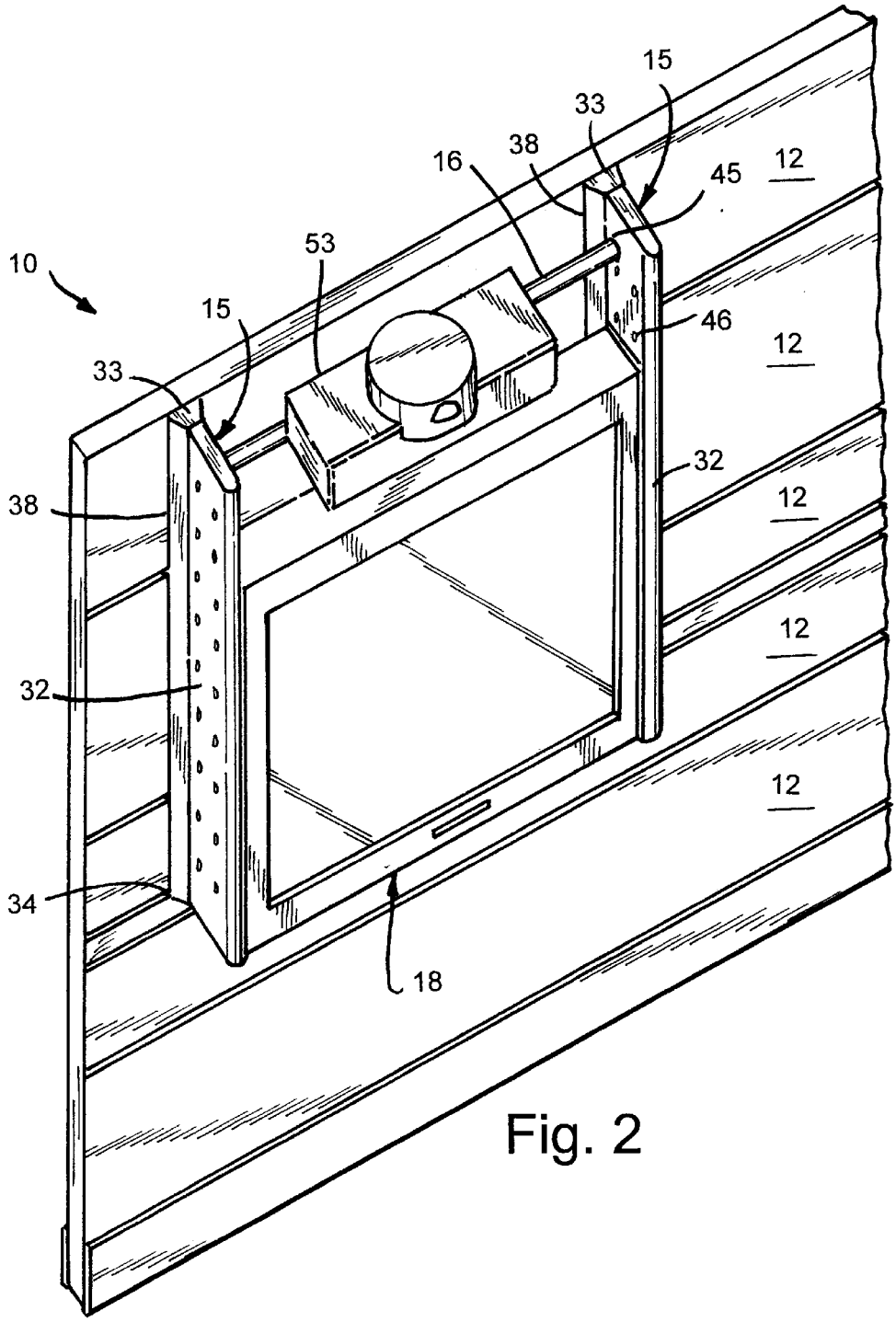
FIG. 2 is a perspective view of the adjustable rack and partition system shown in FIG. 1, including a plasma screen attached to the adjustable rack.

The components 18 (FIG. 3) can be many different widths, heights, depths, weights, and shapes. For example, the illustrated components 18 are plasma screens. There is currently no universal attachment scheme for such plasma screens 18, and accordingly they occur in virtually an infinite variety of configurations and arrangements. Further, such components 18 often require a separate control box or electrical hookup box, as illustrated by box 53 (FIG. 2).

An additional wire manager 54 (FIG. 4) is provided. The wire manager 54 is hat shaped and is configured to be attached below blade 15. The wire manager 54 extends from a bottom of blade 15 to a lower location where wires 55 can be extended into a partition frame 11 without being visible, yet without cutting a hole into the covers 12. Also, it is contemplated that wire ties 56 will be used liberally as needed to control wiring 57 and cables 58 that extend horizontally, such as by tying the wiring 57 and cables 58 to the horizontal support 16.

In the foregoing description, it will be readily appreciated by persons skilled in the art that modifications may be made to the invention without departing from the concepts disclosed herein. Such modifications are to be considered as included in the following claims, unless these claims by their language expressly state otherwise.

The invention claimed is:

1. A wall system comprising:

a wall section having a horizontal frame defining a horizontal row of attachment sites;

an adjustable bracket including a pair of vertical blades, the vertical blades each having a plurality of vertically spaced mounting locations, each of the blades constructed to engage selected ones of the attachment sites, and further including at least one telescoping horizontal support attachable to the blades at selected ones of the mounting locations, and the telescoping horizontal support spanning between and supported by the pair of vertical blades, and still further including universal connectors for engaging the telescoping horizontal support, the universal connectors being resecurable and longitudinally repositionable on the telescoping horizontal support.

2. The wall system defined in claim 1, wherein the at least one telescoping horizontal support includes a telescoping main tube.

3. The wall system defined in claim 2, wherein the at least one telescoping horizontal support includes a side tube telescopingly engaging an end of the main tube.

4. The wall system defined in claim 3, wherein the at least one telescoping horizontal support includes a second side tube telescopingly engaging an opposite end of the main tube.

5. A wall system comprising:

a wall section having a horizontal frame defining a horizontal row of attachment sites; and an adjustable bracket including a pair of vertical blades constructed to engage selected ones of the attachment sites, and further including at least one telescoping horizontal support spanning between and supported by the pair of vertical blades, and still further including universal connectors for engaging the telescoping horizontal support;

wherein the at least one telescoping horizontal support includes a telescoping main tube and a side tube telescopingly engaging an end of the main tube, and the telescoping side tube threadably engages the main tube.

6. The wall system defined in claim 1, wherein the at least one telescoping horizontal support includes a pair of telescoping horizontal supports that extends parallel each other.

7. The wall system defined in claim 1, wherein the universal connectors include a first end configured to horizontally adjustably engage the at least one telescoping horizontal support.

8. The wall system defined in claim 7, wherein the universal connectors include a second end having a slot therein for adjustably engaging a component attachment point.

9. The wall system defined in claim 1, wherein the wall section includes a second horizontal row of attachment sites, and wherein the pair of vertical blades includes top and bottom hook-shaped connectors for frictionally engaging the first-mentioned and the second horizontal row of attachment sites, respectively.

10. The wall system defined in claim 1, including a wire manager cover configured to attach to one of the wall section and the blades at a location adjacent the wall section.

11. The wall system defined in claim 1, including a wire manager configured to attach to the wall section at a location generally below one of the vertical blades.

12. The wall system defined in claim 1, wherein the wall section comprises a partition.

13. The wall system defined in claim 12, wherein the horizontal row of attachment sites comprises a first row of discrete slots.

14. The wall system defined in claim 13, wherein the horizontal frame includes a second row of slots, and wherein the pair of vertical blades includes hooks configured to horizontally/laterally engage the first row of slots and the second row of slots.

15. The wall system defined in claim 14, wherein the at least one telescoping horizontal support includes hooks at each end configured to engage apertures in sides of the pair of vertical blades.

16. The wall system defined in claim 15, wherein the pair of vertical blades includes inwardly facing sides, the inwardly facing sides disposed in a mutually facing relationship, the inwardly facing sides having the apertures therein.

17. The wall system defined in claim 1, wherein the pair of vertical blades extends downwardly and includes floor-engaging feet.

18. The wall system defined in claim 1, wherein the inventing locations comprise includes a series of apertures, some of which are located closer to the wall section and others of which are located farther from the wall section, and further includes some apertures that are vertically spaced from other apertures.

19. The wall system defined in claim 1, wherein at least one of the pair of vertical blades includes a vertically adjustable telescoping portion.

20. The wall system defined in claim 1, including a component attached to the at least one telescoping horizontal support.

21. The wall system defined in claim 20, wherein the at least one telescoping horizontal support includes two horizontal supports.

22. A method comprising steps of:

providing a wall having a frame with a horizontal row of attachment sites thereon;

providing an adjustable bracket configured to selectively engage the attachment sites, and that includes a pair of vertical blades, at least one horizontally extendable support, and universal connectors;

providing a component having attachment locations thereon;

repositionably attaching the pair of vertical blades to the wall at a spacing sufficient to receive the component therebetween:

attaching the at least one horizontally extendable support to the pair of vertical blades including adjusting a length of the at least one horizontally extendable support; and using the universal connectors to attach the component to the at least one horizontally extendable support, including adjusting the universal connectors to engage the attachment locations.

23. A wall system comprising:

a wall section having a plurality of attachment sites;

a pair of vertical blades, each vertical blade having a major planar surface disposed at an angle to the wall section, and wherein the blades are constructed to engage selected ones of the attachment sites;

first and second telescoping horizontal supports spanning between and supported by the pair of vertical blades;

first and second universal connectors respectively engaged with the first and second telescoping horizontal supports; and a component attached to each of the first and second universal connectors.

* * * * *

UNITED STATES PATENT AND TRADEMARK OFFICE

CERTIFICATE OF CORRECTION

PATENT NO. : 6,230,445 B1
DATED : May 15, 2001
INVENTOR(S) : Robert P. Arko et al.

It is certified that error appears in the above-identified patent and that said Letters Patent is hereby corrected as shown below:

Column 3,
Lines 12-13, delete "--therefor";

Column 4, claim 1,
Line 59, insert -- and --;

Column 6, claim 18,
Line 14, "inventing" should be -- mounting --;
Line 14, delete "includes".

Signed and Sealed this

Second Day of April, 2002

*Attest:*

*Attesting Officer*

JAMES E. ROGAN
*Director of the United States Patent and Trademark Office*